US012630199B2

(12) United States Patent
Krismanic et al.

(10) Patent No.: US 12,630,199 B2
(45) Date of Patent: May 19, 2026

(54) PNEUMATIC SAND CONVEYING DEVICE FOR A SANDING SYSTEM OF A RAIL VEHICLE, SANDING SYSTEM, AND METHOD FOR OPERATING A PNEUMATIC SAND CONVEYING DEVICE

(71) Applicant: KNORR-BREMSE GESELLSCHAFT MIT BESCHRÄNKTER HAFTUNG, Mödling (AT)

(72) Inventors: Georg Krismanic, Wein (AT); Albert Missliwetz, Wein (AT)

(73) Assignee: KNORR-BREMSE GESELLSCHAFT MIT BESCHRÄNKTER HAFTUNG (AT)

( * ) Notice: Subject to any disclaimer, the term of this patent is extended or adjusted under 35 U.S.C. 154(b) by 574 days.

(21) Appl. No.: 18/024,044

(22) PCT Filed: Aug. 30, 2021

(86) PCT No.: PCT/EP2021/073867
§ 371 (c)(1),
(2) Date: Feb. 28, 2023

(87) PCT Pub. No.: WO2022/043546
PCT Pub. Date: Mar. 3, 2022

(65) Prior Publication Data

US 2023/0278597 A1 Sep. 7, 2023

(30) Foreign Application Priority Data

Aug. 31, 2020 (DE) ..... 10 2020 122 640.3

(51) Int. Cl.
*B61C 15/10* (2006.01)

(52) U.S. Cl.
CPC ..... *B61C 15/102* (2013.01)

(58) Field of Classification Search
CPC ..... B61C 15/102
See application file for complete search history.

(56) References Cited

U.S. PATENT DOCUMENTS 2,577,009 A 12/1951 Frantz
2021/0107315 A1 4/2021 Gronau

FOREIGN PATENT DOCUMENTS

CN 209381997 U * 9/2019
DE 1279057 B 10/1968
(Continued)

OTHER PUBLICATIONS

International Search Report and Written Opinion corresponding to PCT/EP2021/073867 dated Dec. 21, 2021.

*Primary Examiner* — Robert J McCarry, Jr.
(74) *Attorney, Agent, or Firm* — Barnes & Thornburg LLP

(57) ABSTRACT

A pneumatic sand conveying device for a sanding system of a rail vehicle includes an obstacle device which is fluidically coupled to a sand input for receiving sand from a sand storage container, the obstacle device being shaped to form an obstacle between the sand input and a mixing device fluidically coupled to the obstacle device. In addition, the sand conveying device has the mixing device for receiving and forwarding sand from the obstacle device by compressed air and a discharge device fluidically coupled to the mixing device to dispense the sand from the sand conveying device through a sand outlet. The obstacle device, the mixing device and the discharge device are arranged in a horizontal plane when the sand conveying device is in a state ready for operation.

14 Claims, 6 Drawing Sheets

(56) References Cited

FOREIGN PATENT DOCUMENTS

| | | | | | |
|---|---|---|---|---|---|
| DE | 8808842 | U1 | | 9/1988 | |
| DE | 19547746 | A1 | | 7/1996 | |
| DE | 29711805 | U1 | | 9/1997 | |
| DE | 10252466 | A1 | | 5/2004 | |
| DE | 202014105936 | U1 | | 2/2015 | |
| DE | 102017205622 | A1 | | 10/2018 | |
| EP | 0816129 | A2 | * | 1/1998 | ..... B60B 39/086 |
| EP | 1312488 | A2 | * | 5/2003 | ..... B61C 15/10 |
| EP | 1418108 | B1 | | 11/2007 | |
| FR | 2680491 | B1 | | 11/1993 | |
| GB | 1591900 | A | | 7/1981 | |
| GB | 2202506 | A | | 9/1988 | |
| WO | WO-2016134397 | A1 | * | 9/2016 | ..... B61C 15/102 |

* cited by examiner

PNEUMATIC SAND CONVEYING DEVICE FOR A SANDING SYSTEM OF A RAIL VEHICLE, SANDING SYSTEM, AND METHOD FOR OPERATING A PNEUMATIC SAND CONVEYING DEVICE

CROSS REFERENCE AND PRIORITY CLAIM

This patent application is a U.S. National Phase of International Patent Application No. PCT/EP2021/073867 filed Aug. 30, 2021, which claims priority to German Patent Application No. 10 2020 122 640.3, the disclosure of which being incorporated herein by reference in their entireties.

FIELD

The present approach relates to a pneumatic sand conveying device for a sanding system of a rail vehicle, to a sanding system having a pneumatic sand conveying device, and to a method for operating a pneumatic sand conveying device.

BACKGROUND

In rail vehicles, sanding systems are used to deliver sand onto the rail in front of the wheel rolling over it or directly into the wheel rail gap in order to increase the coefficient of friction between the wheel and the rail. For this purpose, sand is drawn from a sand storage container, ideally at its lowest point, by sand conveying devices, or sand metering and conveying devices, and appropriately metered and conveyed further. The distance between this lowest point and the outlet of the sand conveying device has a direct influence on the volume of the sand storage container and should accordingly be as small as possible.

SUMMARY

Against this background, disclosed embodiments provide an improved pneumatic sand conveying device for a sanding system of a rail vehicle, an improved sanding system with a pneumatic sand conveying device, and a method for operating an improved pneumatic sand conveying device.

BRIEF DESCRIPTION OF THE FIGURES

Exemplary embodiments of the approach presented here are explained in more detail in the following description with reference to the figures. Specifically.

Figure 1:
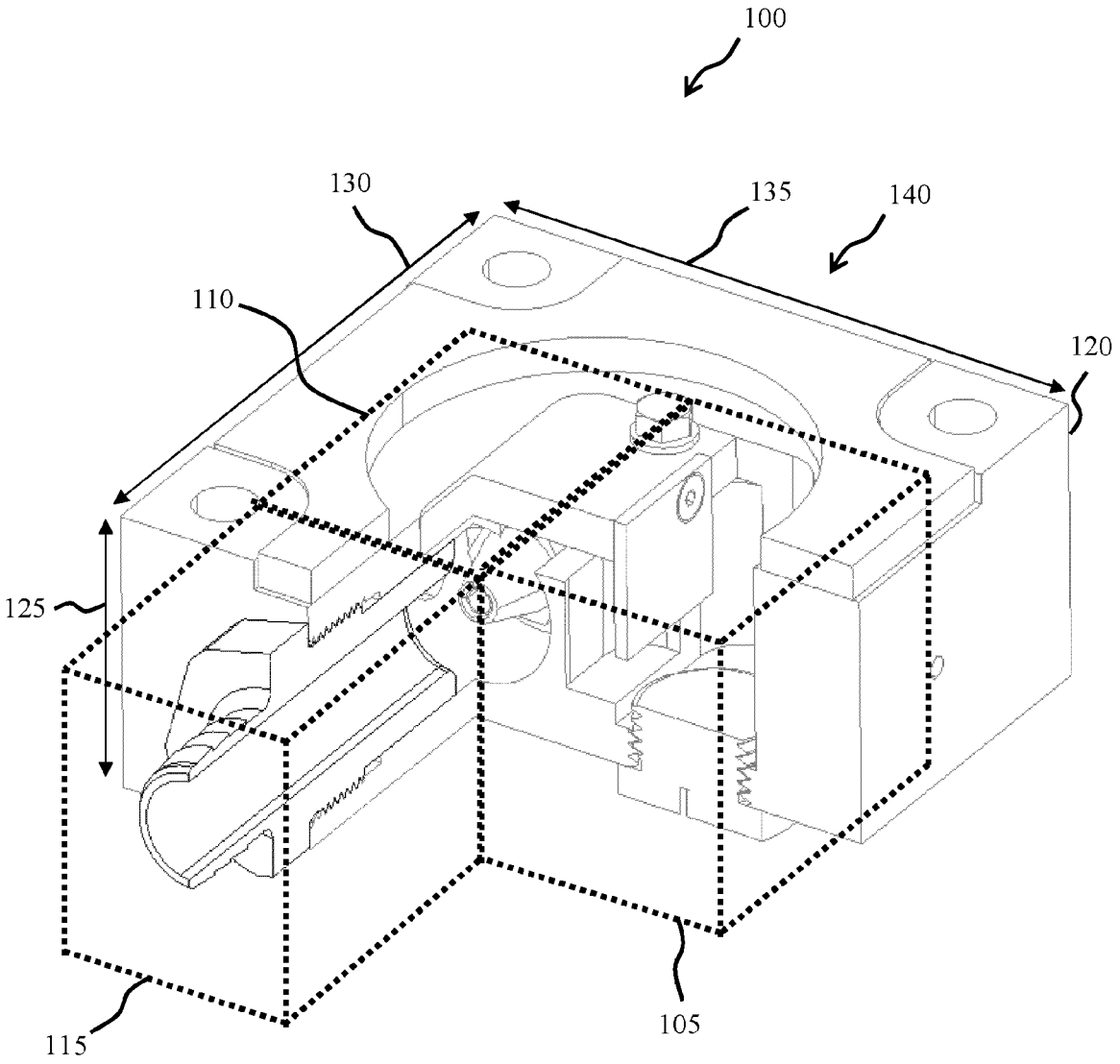
FIG. 1 shows a schematic illustration of one exemplary embodiment of a pneumatic sand conveying device having an obstacle device, a mixing device and an outlet device.

In the following description of favorable exemplary embodiments of the present approach, identical or similar reference signs are used for the elements illustrated in the various figures and having a similar effect, while repeated description of these elements is avoided.

DETAILED DESCRIPTION

Disclosed embodiments provide an improved pneumatic sand conveying device for a sanding system of a rail vehicle, an improved sanding system with a pneumatic sand conveying device, and a method for operating an improved pneumatic sand conveying device.

Technical utility can be achieved with the approach presented are, in particular, that a particularly compact sand conveying device is produced, in which a distance between a position of a sand inlet, at which sand is drawn from a sand storage container during operation of the sand conveying device, and a position of a sand outlet of the sand conveying device is particularly small and, as a result, it is possible, for example, to use a larger sand storage container, which can also be referred to as a sand box.

A pneumatic sand conveying device for a sanding system of a rail vehicle is presented, wherein the sand conveying device has the following features: an obstacle device, which is fluidically coupled to a sand inlet for receiving sand from a sand storage container, wherein the obstacle device is configured to form an obstacle between the sand inlet and a mixing device fluidically coupled to the obstacle device. Moreover, the sand conveying device has the mixing device for receiving and forwarding sand from the obstacle device by compressed air, and an outlet device, fluidically coupled to the mixing device, for dispensing the sand from the sand conveying device through a sand outlet, wherein the obstacle device, the mixing device and the outlet device are arranged in a horizontal plane when the sand conveying device is in a state of readiness for operation.

In particular, the horizontal arrangement has the technical utility that the sand conveying device can have a very compact design and the height difference between the sand inlet of the sand conveying device and the sand outlet is substantially smaller than is possible in the case of an arrangement vertically one below the other in the state of readiness for operation. When fitted to a rail vehicle with the largest possible sand storage container, it is accordingly possible to maintain the greatest possible distance from the rails. The sand conveying device can also be designed for conveying some other free-flowing material that differs from sand.

According to a disclosed embodiment, the obstacle device, the mixing device and the outlet device can be arranged within a common housing. For example, these devices or parts of the devices can also be incorporated directly into the housing, thereby making it possible to achieve a one-piece and additionally or alternatively cuboidal shape of the sand conveying device. This has the technical utility that the sand conveying device can be designed to be as compact as possible.

According to a further embodiment, a maximum height of the sand conveying device can be smaller than a maximum depth and additionally or alternatively a maximum width of the sand conveying device. For example, the obstacle device, the mixing device and the outlet device can be arranged side-by-side on a horizontal plane in the state of readiness for operation, as a result of which the width and additionally or alternatively the depth of the sand conveying device is greater than the height. The position at which the sand conveying device obtains the sand should ideally correspond to the lowest point of the sand storage container to enable the sand supply to be fully utilized. Accordingly, the volume of the sand storage container can be the larger, the lower the lowest point of the sand storage container, with otherwise the same dimensions. On the other hand, the position of the sand outlet of the sand conveying device should not be too low since otherwise the height difference between this sand outlet of the sand conveying device and a sand hose or pipe outlet located close to the rail is too small for optimum and reliable sand application. In the embodiment described here, the distance between the sand inlet and the sand outlet of the sand conveying device can advantageously be kept to a minimum.

According to a further embodiment, the diameter of the sand outlet can substantially coincide with a maximum height of the sand conveying device. Thus, the height of the sand conveying device can be determined exclusively by the diameter of the sand outlet and a sand hose or pipe connected there, thereby advantageously enabling the height of the sand conveying device to be made very small and the sand conveying device as a whole to be made very compact. In the context of the approach presented here, the expression "substantially" can, in particular, denote a deviation in the case of length data of up to +/−20%.

According to a further embodiment, the sand inlet and the sand outlet can be arranged substantially perpendicular to one another. In a state of readiness for operation, the sand inlet can be arranged, for example, on the main surface of the sand conveying device in order to receive the sand from the lowest point of the sand storage container arranged thereabove. The sand outlet can be arranged, for example, on one side of the sand conveying device. Such an arrangement has the technical utility that the previously described distance between the sand inlet and the sand outlet can be minimized. In the context of the approach presented here, the expression "substantially" can, in particular, encompass a deviation in the case of angle data of up to +/−20°.

According to a further embodiment, the obstacle device can comprise a labyrinth unit arranged toward the mixing device and having a leaf and a step, wherein the labyrinth unit can be configured to prevent the sand from running out of the obstacle device into the mixing device. For example, the obstacle device can have a recess milled into the housing, wherein the step can be formed toward the side of the mixing device. The leaf can project slightly offset toward this step, thus ensuring that an angular gap or channel remains open. Advantageously, the labyrinth unit arranged in this way can prevent sand from the obstacle device entering the mixing device independently, it being possible at the same time to ensure that the sand can be sucked into the mixing device, which can also be referred to as a mixing chamber, for example by reduced pressure.

According to a further embodiment, the obstacle device can have a threaded drain plug for draining the sand from the obstacle device. The threaded drain plug can be arranged, for example, on the side of the obstacle device opposite the sand inlet and additionally or alternatively terminate flush with the housing of the sand conveying device in the closed state. Advantageously, the threaded drain plug can be opened when the sand is to be drained completely from the obstacle device, e.g. for servicing purposes.

According to a further embodiment, the sand conveying device can have a throttle, which is arranged between a sanding compressed-air connection for providing the compressed air and the mixing device, wherein the throttle is designed to throttle the compressed air. For example, the throttle can be used if the supplied compressed air is to be reduced to a certain extent or if a flow velocity of the compressed air is to be lowered. This has the technical utility that the discharge of the sand can be metered as accurately as possible by a possibly throttled compressed air supply.

According to a further embodiment, the outlet device can have a hose connection piece, which is arranged at the sand outlet and is arranged axially with respect to a nozzle, arranged in the mixing device, for supplying compressed air, in particular wherein the hose connection piece can be tapered in its interior and additionally or alternatively configured as a Laval nozzle and additionally or alternatively can comprise a Laval nozzle. For example, the compressed air can flow through the nozzle from the sanding compressed-air connection and optionally through a throttle. The nozzle can produce a reduced pressure in the mixing device in conjunction with the hose connection piece, which is configured, for example, as a Laval nozzle. This reduced pressure can suck sand through the labyrinth unit from the obstacle device, into which the sand can have previously passed from the sand storage container by gravity. In the mixing device, the sand can mix with the air from the nozzle and can be accelerated in the direction of the sand outlet and conveyed further through the hose connection piece and a connected sand hose. In this case, the configuration of the hose connection piece as a Laval nozzle or the integration of a Laval nozzle is particularly advantageous in order to produce the required reduced pressure.

According to a further embodiment, the sand conveying device can comprise a blowout compressed-air connection for providing blowout compressed air for blowing out the mixing device, wherein the blowout compressed-air connection can be arranged substantially perpendicular to the hose connection piece and the nozzle.

For example, the blowout compressed air can be applied to the blowout compressed-air connection, which can also be referred to as the compressed-air connection for blowout. The air flow can divide in the direction of the outlet device and in the direction of the obstacle device. That is to say that part of the air can flow through the hose connection piece and, for example, a connected sand hose and blow out the sand still present in this region. Advantageously, easy cleaning of the hose connection piece and a connected sand hose is possible in this way.

At the same time, a further part of the air can flow via the labyrinth unit into the sand storage container, for example, and thus loosen or fluidize the sand present in the obstacle device and in the vicinity of the sand conveying device. At the same time as blowout compressed air is applied to the blowout compressed-air connection, compressed air can optionally also be applied to the sanding compressed-air connection. This has the technical utility that no sand grains can get into the nozzle and thus cannot clog it either. Furthermore, the distribution of the air flow in favor of the air flow through the hose connection piece can be influenced in this way. This can be advantageous in the case of long sand hoses, which present a higher air resistance.

According to a further embodiment, the sand conveying device can have a heating element, arranged on the sanding compressed-air connection and additionally or alternatively on the blowout compressed-air connection, for heating the supplied compressed air and additionally or alternatively blowout compressed air. Thus, the air can be heated and the sand can be heated and dried by the warm air. This has the technical utility that the sand can be protected from penetrating moisture and additionally or alternatively cold, for example in the winter months.

According to a further embodiment, the sand conveying device can comprise a compensating air duct for compensating reduced pressure arising in the mixing device, in particular wherein the compensating air duct is fluidically coupled to the obstacle device via a second labyrinth unit. The compensating air duct can also be referred to as an entrained air duct and can be arranged on one side of the obstacle device, for example. Via a second labyrinth unit, which, as in the case of the labyrinth unit described above, can comprise a step and a leaf, the compensating air duct can connect a compensating air inlet, which can also be referred to as an entrained air inlet, to the obstacle device. Advantageously, this second labyrinth unit can prevent sand from entering the environment via the compensating air duct, it being possible at the same time to allow air (entrained air) to flow from the compensating air inlet to the compensating air duct. In this case, the compensating air duct can be configured in such a way that it can be closed, for example, in order advantageously to allow pressure compensation in the obstacle device if this is required. In addition or as an alternative, an unwanted reduced pressure in the obstacle device can also be compensated for by additional air flowing in from the sand storage container and additionally from the environment via, for example, entrained air openings in the sand storage container.

In addition, a sanding system with a variant of the above-described pneumatic sand conveying device and a sand storage container for storing sand is presented, in particular wherein a main surface of the sand conveying device can be coupled or can be configured in such a way that it can be coupled to the sand storage container. In this case, the main surface of the sand conveying device can be sealed off from the sand storage container, for example by a suitable seal, in order to prevent unwanted penetration of air. By such a combination, the technical utility described above can be optimally implemented.

In addition, a method for operating a variant of a previously described pneumatic sand conveying device is presented, wherein the method has the following operation of feeding compressed air into the mixing device of the sand conveying device in order to cause sand to be ejected from the outlet device of the sand conveying device. Alternatively or in addition, in the operation of feeding, compressed air can be fed into the obstacle device of the sand conveying device in order to cause sand to be blown out of the obstacle device, mixing device and outlet device of the sand conveying device. Alternatively or in addition, in the operation of feeding, feeding of compressed air into the mixing device of the sand conveying device with simultaneous feeding of compressed air into the obstacle device of the sand conveying device can also take place in order to cause sand to be ejected from the outlet device of the sand conveying device with increased conveying air. This method can be implemented, for example, in software or hardware or in a hybrid form of software and hardware, for example in a control unit.

FIG. 1 shows a schematic illustration of one exemplary embodiment of a pneumatic sand conveying device 100 having an obstacle device 105, a mixing device 110 and an outlet device 115. In this exemplary embodiment, these three main components of the sand conveying device 100, which can also be referred to as an obstacle, mixer and outlet for short, are distinguished from one another in the illustration by indicated lines. The obstacle device 105, mixing device 110 and outlet device 115 are arranged in a horizontal plane in a state of readiness 140, shown here, of the sand conveying device 100. According to this exemplary embodiment, purely by way of example, the obstacle device 105, mixing device 110 and outlet device 115 are furthermore arranged in a housing 120, wherein the height 125 of the housing 120 and thus of the entire sand conveying device 100 is, according to this exemplary embodiment, smaller than the depth 130 of the housing 120 and here, by way of example, also smaller than the width 135 of the housing 120. Here, purely by way of example, the housing 120 is configured in a cuboidal shape and/or in one piece overall.

Figure 2:
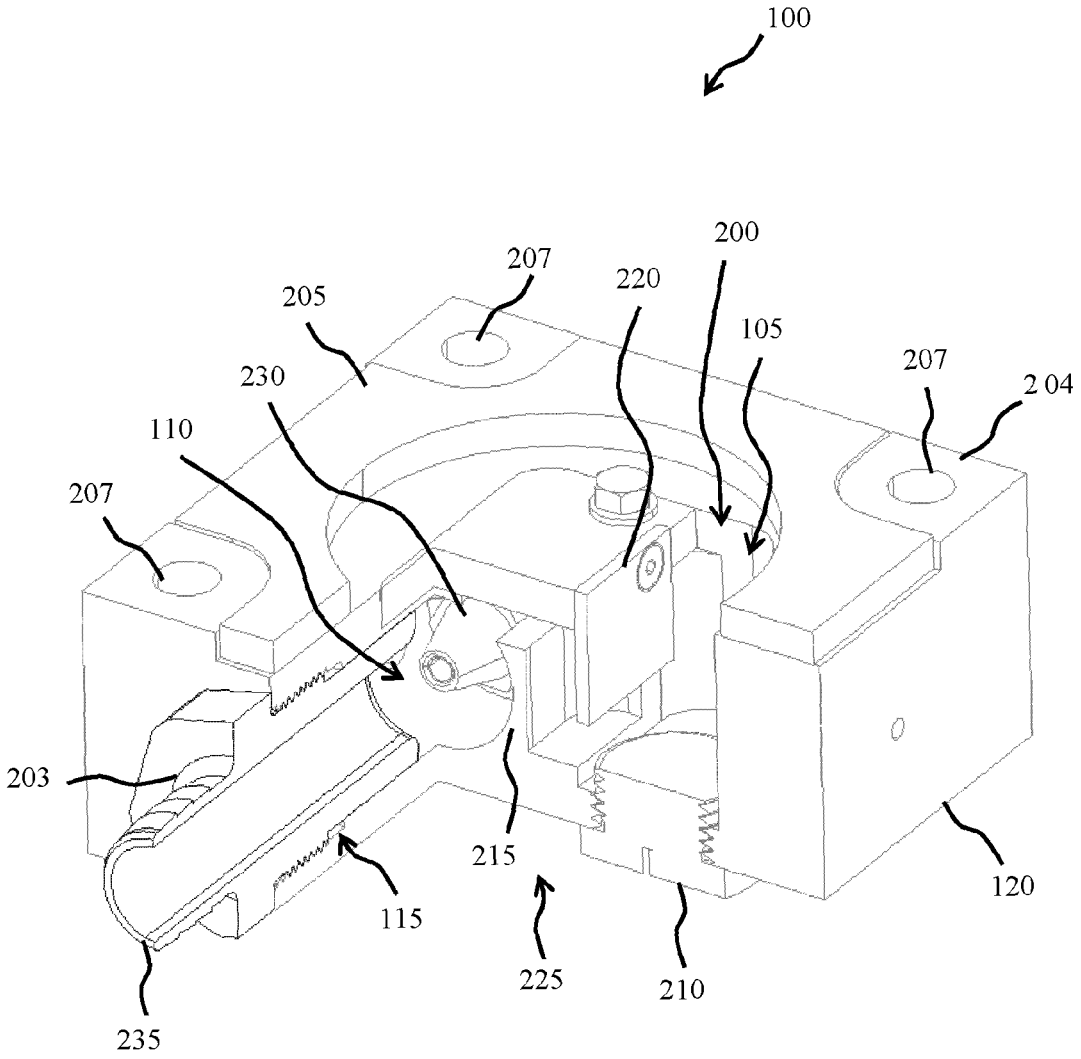
FIG. 2 shows a schematic illustration of one exemplary embodiment of a sand conveying device.

FIG. 2 shows a schematic illustration of one exemplary embodiment of a sand conveying device 100. This can be the sand conveying device 100 described in FIG. 1, with the difference that the boundaries of the obstacle device 105, mixing device 110 and outlet device 115 are not emphasized by additional lines as in FIG. 1. It can be seen in FIG. 2 that the obstacle device 105 is fluidically coupled to a sand inlet 200 for receiving sand from a sand storage container (not illustrated here), wherein the obstacle device 105 is configured to form an obstacle between the sand inlet 200 and the mixing device 110 fluidically coupled to the obstacle device 105. The mixing device 110 is designed to receive and pass on sand from the obstacle device 105 by compressed air. The outlet device 115 is fluidically coupled to the mixing device 110 and is designed to discharge the sand from the sand conveying device 100 through a sand outlet 203.

In this exemplary embodiment, a main surface 204 of the housing 120 comprises a seal 205 for sealing the sand conveying device 100 with respect to the sand storage container. According to this exemplary embodiment, the main surface 204 of the housing 120 is the largest surface area compared to other surfaces of the housing 120. In this case, the main surface 204 is shown partially open to allow a detailed illustration of the components arranged thereunder. Using mounting holes 207, the main surface 204 and with it the entire sand conveying device 100 can be coupled to the sand storage container.

In this exemplary embodiment, the obstacle device 105 is configured as a recess in the housing 120 and, according to one exemplary embodiment, is milled into the housing 120. According to this exemplary embodiment, by way of example, a threaded drain plug 210 is arranged in the lower region of the obstacle device 105, providing the possibility of draining sand for servicing purposes. Arranged on a side of the obstacle device 105 which is arranged substantially centrally in the sand conveying device 100 are a step 215 projecting from a bottom of the housing 120 and a leaf 220 projecting slightly offset and in the opposite direction. In the arrangement shown here, the step 215 and the leaf 220 form a labyrinth unit 225. When there is sand in the obstacle device 105, for example, the labyrinth unit 225 can prevent unintentional onward flow of the sand into the mixing device 110. At the same time, however, it is possible to actively suck the sand, for example by reduced pressure, through an opening between the step 215 and the leaf 220.

According to this exemplary embodiment, the mixing device 110 arranged next to the obstacle device 105 comprises a nozzle 230, by which compressed air can be introduced into the mixing device 110. According to different exemplary embodiments, the mixing device 110 is drilled or milled into the housing 120, for example, like the obstacle device 105, wherein the nozzle 230 is arranged axially with respect to the mixing device 110. With this system comprising mixing device 110 and nozzle 230, sand can be sucked out of the sand storage container via the obstacle device 105 by reduced pressure, appropriately metered and conveyed further through the outlet device 115.

In this exemplary embodiment, the outlet device 115 comprises a hose connection piece 235 which is arranged at the sand outlet 203 and is aligned axially with respect to the nozzle 230. According to this exemplary embodiment, the hose connection piece 235 is tapered, for example, in the interior or else designed as a Laval nozzle, thus enabling a suction effect of the nozzle 230 to be intensified. According to an alternative exemplary embodiment, a Laval nozzle is installed as a separate part in a cavity of the hose connection piece 235.

According to this exemplary embodiment, the sand conveying device 100 shown here advantageously implements a compact sand metering and conveying device with a horizontal sand outlet 203.

Figure 3:
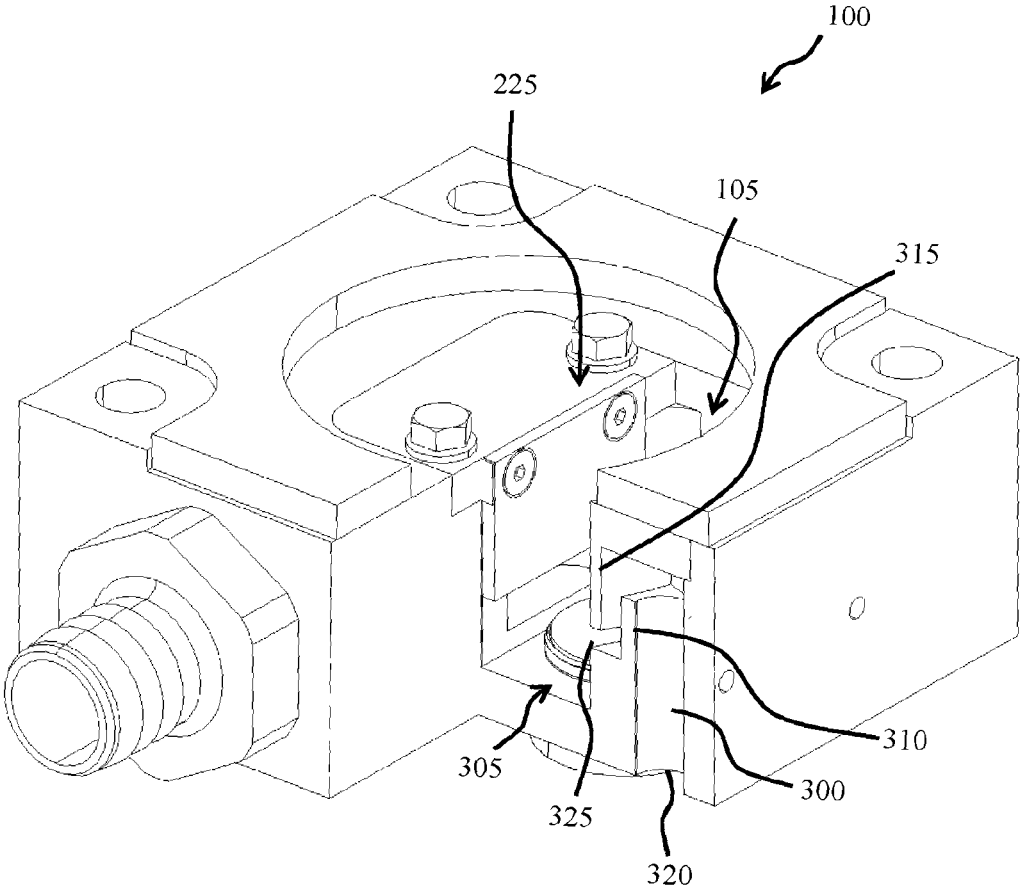
FIG. 3 shows a schematic illustration of one exemplary embodiment of a sand conveying device having a compensating air duct.

FIG. 3 shows a schematic illustration of one exemplary embodiment of a sand conveying device 100 having a compensating air duct 300. This may be an exemplary embodiment of the sand conveying device 100 described in FIG. 1 or 2. With such a compensating air duct 300 within the sand conveying device 100, it is possible to achieve pressure compensation. In this exemplary embodiment, the compensating air duct 300 is arranged on a side of the obstacle device 105 opposite the labyrinth unit 225 and is configured as a second labyrinth unit 305 with a second step 310 and a second leaf 315. By a compensating air inlet 320, which can also be referred to as an entrained air inlet, air can be passed from an outer region of the sand conveying device 100 to a compensating air outlet 325, which can also be referred to as an entrained air outlet, into the obstacle device 105. Here, the second labyrinth unit 305 forms an obstacle, ensuring that no sand can reach the environment from the obstacle device 105 via the compensating air duct 300.

Figure 4:
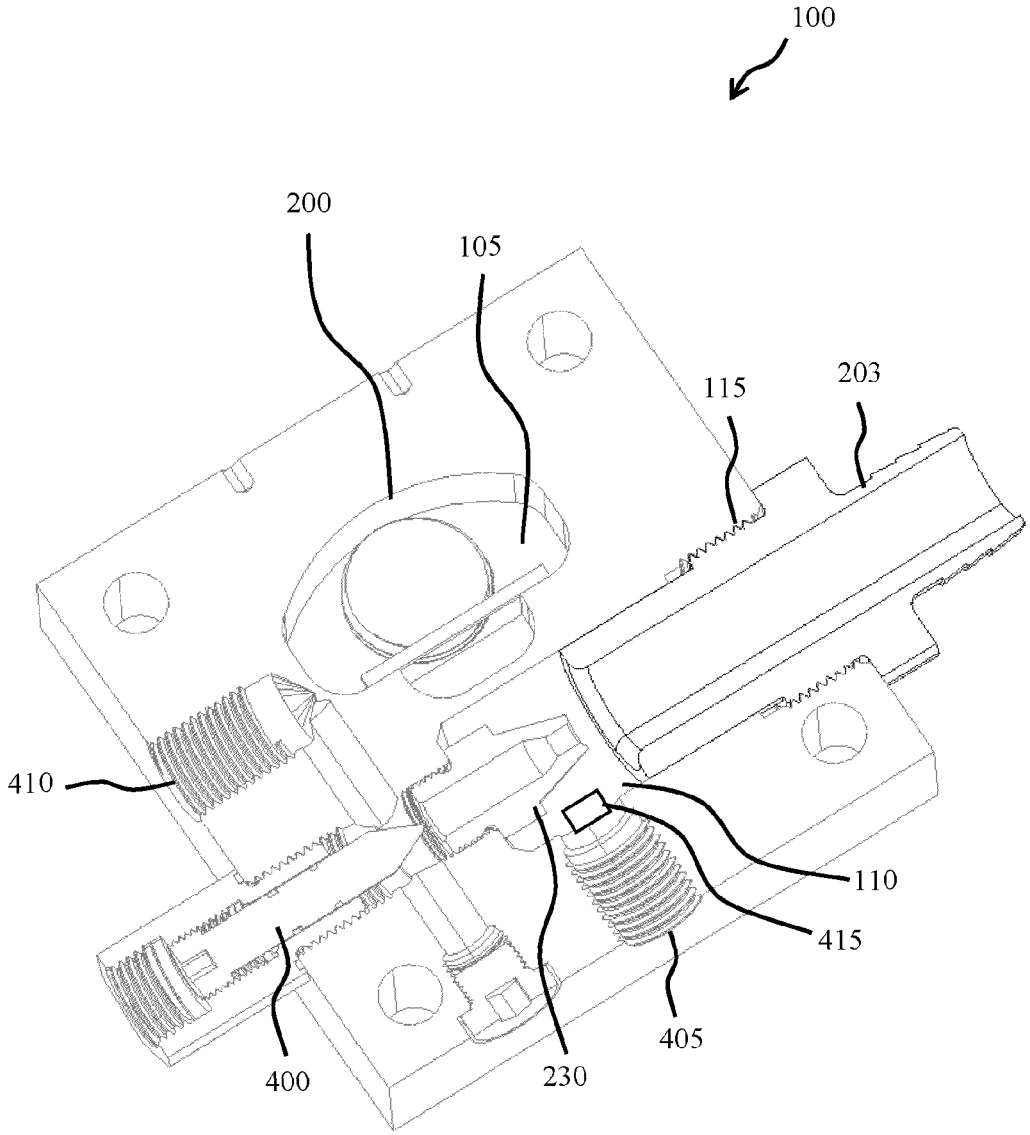
FIG. 4 shows a schematic illustration of a plan view of one exemplary embodiment of a sand conveying device having a throttle and a blowout compressed-air connection.

FIG. 4 shows a schematic illustration of a plan view of one exemplary embodiment of a sand conveying device 100 having a throttle 400 and a blowout compressed-air connection 405. This may be an exemplary embodiment of the sand conveying device 100 described in FIG. 1, 2 or 3. In this exemplary embodiment, the throttle 400 is arranged between a sanding compressed-air connection 410, which can also be referred to as a compressed-air connection for sanding, and the nozzle 230.

When required, the throttle 400 can reduce the pressure at the sanding compressed-air connection 410 and thus achieve a desired lower suction power and corresponding sand metering. As an additional supplement to the sand conveying device 100, the blowout compressed-air connection 405, which can also be referred to as the compressed-air connection for blowout, is arranged on the mixing device 110 in this exemplary embodiment, wherein the blowout compressed-air connection 405 is arranged perpendicular to the nozzle 230 according to this exemplary embodiment. Blowout compressed air can be applied to the blowout compressed-air connection 405, by which compressed air, for example for cleaning purposes, sand can be blown out of the sand conveying device 100. In addition, a heating element 415 is arranged on the blowout compressed-air connection 405 to enable the blowout compressed air to be heated and thus the sand and/or the sand conveying device 100 to be dried and/or the sand conveying device 100 and the sand to be protected from icing.

The air flow can be divided, for example, in the direction of the outlet device 115 and in the direction of the obstacle device 105, allowing part of the blowout compressed air to flow through the hose connection piece 235 and blow out the sand still present in this region. Another part of the blowout compressed air can flow via the obstacle device 105 and the sand inlet 200 into the sand storage container and loosen the sand present in the obstacle device 105. If the air is additionally heated by the heating element 415, the sand can also be heated and dried by the warm blowout compressed air.

Figure 5:
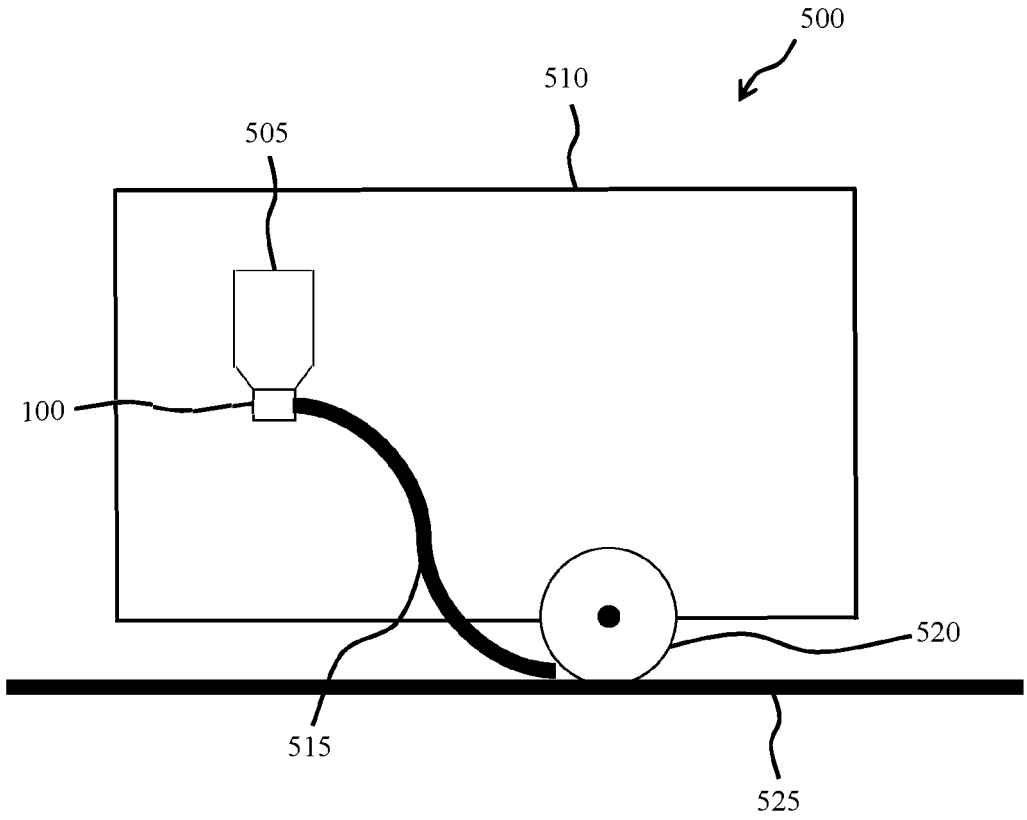
FIG. 5 shows a schematic illustration of one exemplary embodiment of a sanding system.

FIG. 5 shows a schematic illustration of one exemplary embodiment of a sanding system 500. The sanding system 500 has the pneumatic sand conveying device 100 described in one of the preceding figures and the sand storage container 505 for storing sand. According to this exemplary embodiment, purely by way of example, the main surface of the sand conveying device 100 is coupled to the sand storage container 505. In this exemplary embodiment, the sand storage container 505 is arranged on a rail vehicle 510 and coupled at its lowest point to the sand conveying device 100. From the sand conveying device 100, a sand hose 515 leads to a wheel 520 of the rail vehicle 510, wherein the wheel 520 is arranged on a rail 525. By feeding sand onto the rail 525 in front of the wheel 520, the coefficient of friction between the wheel 520 and the rail 525 can be increased or brought to an originally higher value. By this measure, the traction and braking of the rail vehicle 510 can be improved.

Figure 6:
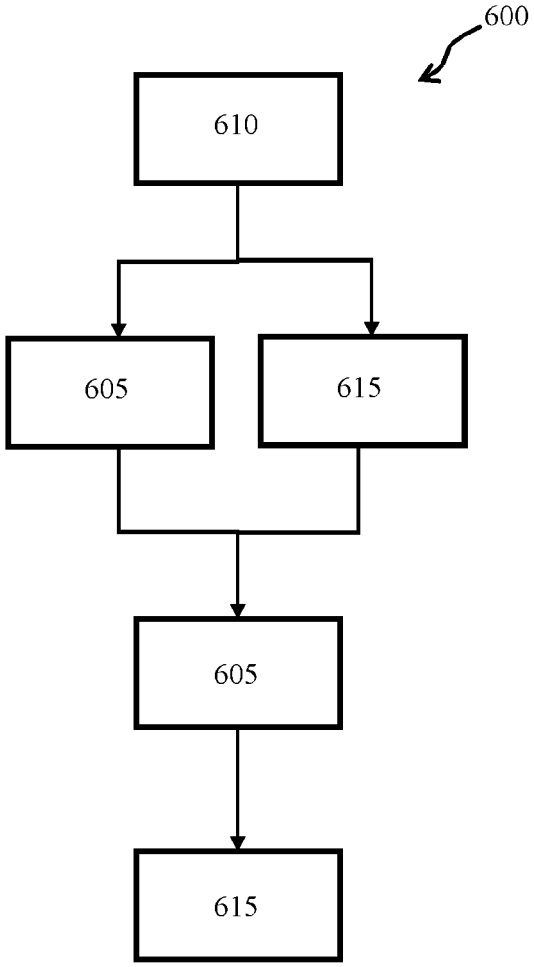
FIG. 6 shows a flow chart of one exemplary embodiment of a method for operating a variant of a sand conveying device presented here.

FIG. 6 shows a flow chart of one exemplary embodiment of a method 600 for operating a variant of one of the sand conveying devices 100 described in one of the preceding figures. The method 600 comprises an operation 605 of feeding compressed air into the mixing device of the sand conveying device in order to cause sand to be ejected from the outlet device of the sand conveying device. As an option, the method 600 according to this exemplary embodiment further comprises, prior to the operation 605 of feeding, an operation 610 of preparation, in which the sand conveying device is prepared. Alternatively or in addition, in the operation of feeding, compressed air can be fed 615 into the obstacle device of the sand conveying device in order to cause sand to be blown out of the obstacle device, mixing device and outlet device of the sand conveying device. Alternatively or in addition, in the operation of feeding, feeding 605 of compressed air into the mixing device of the sand conveying device with simultaneous feeding of compressed air into the obstacle device of the sand conveying device can also take place in order to cause sand to be ejected from the outlet device of the sand conveying device with increased conveying air.

LIST OF REFERENCE SIGNS

100 pneumatic sand conveying device
105 obstacle device
110 mixing device
115 outlet device
120 housing
125 height of the sand conveying device
130 depth of the sand conveying device
135 width of the sand conveying device
140 state of readiness for operation
200 sand inlet
203 sand outlet
204 main surface of the sand conveying device
205 seal
207 mounting holes
210 threaded drain plug
215 step
220 leaf
225 labyrinth unit
230 nozzle
235 hose connection piece
300 compensating air duct
305 second labyrinth unit
310 second step
315 second leaf
320 compensating air inlet

325 compensating air outlet
400 throttle
405 blowout compressed-air connection
410 sanding compressed-air connection
415 heating element
500 sanding system
505 sand storage container
510 rail vehicle
515 sand hose
520 wheel
525 rail
600 method for operating a pneumatic sand conveying device
605 feeding compressed air into the mixing device of the sand conveying device
610 preparation
615 feeding compressed air into the obstacle device of the sand conveying device

The invention claimed is:

1. A pneumatic sand conveying device for a sanding system of a rail vehicle, wherein the sand conveying device comprises:

an obstacle device fluidically coupled to a sand inlet for receiving sand from a sand storage container, wherein the obstacle device is configured to form an obstacle between the sand inlet and a mixing device fluidically coupled to the obstacle device;

a mixing device for receiving and forwarding sand from the obstacle device by compressed air the obstacle device preventing the sand from entering the mixing device independent of the compressed air; and an outlet device, fluidically coupled to the mixing device, for dispensing the sand from the sand conveying device through a sand outlet, wherein the obstacle device, the mixing device and the outlet device are arranged in a horizontal plane when the sand conveying device is in a state of readiness for operation.

2. The pneumatic sand conveying device of claim 1, wherein the obstacle device, the mixing device and the outlet device are arranged within a common housing.

3. The pneumatic sand conveying device of claim 1, wherein a maximum height of the sand conveying device is smaller than a maximum depth and/or a maximum width of the sand conveying device.

4. The pneumatic sand conveying device of claim 1, wherein the diameter of the sand outlet substantially coincides with a maximum height of the sand conveying device.

5. The pneumatic sand conveying device of claim 1, wherein the sand inlet and the sand outlet are arranged substantially perpendicular to one another.

6. The pneumatic sand conveying device of claim 1, wherein the obstacle device comprises a labyrinth unit arranged toward the mixing device and having a leaf and a step.

7. The pneumatic sand conveying device of claim 1, wherein the obstacle device has a threaded drain plug for draining the sand from the obstacle device.

8. The pneumatic sand conveying device of claim 1, further comprising a throttle, which is arranged between a sanding compressed-air connection for providing the compressed air and the mixing device, wherein the throttle is configured to throttle the compressed air.

9. The pneumatic sand conveying device of claim 1, wherein the outlet device has a hose connection piece, which is arranged at the sand outlet and is arranged axially with respect to a nozzle, arranged in the mixing device, for supplying compressed air, wherein the hose connection piece is tapered in its interior and/or configured as a Laval nozzle and/or comprises a Laval nozzle.

10. The pneumatic sand conveying device of claim 9, having a blowout compressed-air connection for providing blowout compressed air for blowing out the mixing device, wherein the blowout compressed-air connection is arranged substantially perpendicular to the hose connection piece and the nozzle.

11. The pneumatic sand conveying device of claim 8, having a heating element, arranged on the sanding compressed-air connection and/or on the blowout compressed-air connection, for heating the supplied compressed air and/or blowout compressed air.

12. The pneumatic sand conveying device claim 1, having a compensating air duct for compensating reduced pressure arising in the mixing device, wherein the compensating air duct is fluidically coupled to the obstacle device via a second labyrinth unit.

13. A sanding system having a pneumatic sand conveying device of claim 1 and a sand storage container for storing sand, wherein a main surface of the sand conveying device is coupled or configured for coupling to the sand storage container.

14. A method for operating a pneumatic sand conveying device of claim 1, wherein the method further comprises: feeding compressed air into the mixing device of the sand conveying device to cause sand to be ejected from the outlet device of the sand conveying device and/or feeding compressed air into the obstacle device of the sand conveying device to cause sand to be blown out of the obstacle device, mixing device and outlet device of the sand conveying device and/or feeding compressed air into the mixing device of the sand conveying device while simultaneously feeding compressed air into the obstacle device of the sand conveying device to cause sand to be ejected from the outlet device of the sand conveying device with increased conveying air.

* * * * *